US008425243B2

(12) United States Patent
Alvarez Rivera

(10) Patent No.: US 8,425,243 B2
(45) Date of Patent: Apr. 23, 2013

(54) MAGNETICALLY ACTIVATED CONNECTOR PORT COVER

(75) Inventor: Felix J. Alvarez Rivera, San Jose, CA (US)

(73) Assignee: Apple Inc., Cupertino, CA (US)

( * ) Notice: Subject to any disclaimer, the term of this patent is extended or adjusted under 35 U.S.C. 154(b) by 143 days.

(21) Appl. No.: 13/180,326

(22) Filed: Jul. 11, 2011

(65) Prior Publication Data

US 2013/0017696 A1 Jan. 17, 2013

(51) Int. Cl.
*H01R 13/44* (2006.01)

(52) U.S. Cl.
USPC ..... 439/142; 439/305; 439/38; 439/521; 439/919

(58) Field of Classification Search ..... 439/142, 439/521, 305, 919, 38
See application file for complete search history.

(56) References Cited

U.S. PATENT DOCUMENTS

| | | | | |
|---|---|---|---|---|
| 4,159,858 | A * | 7/1979 | Toraya | 439/38 |
| 4,790,769 | A | 12/1988 | Kanada | |
| 4,993,962 | A | 2/1991 | Noda et al. | |
| 5,385,480 | A * | 1/1995 | Hoffman | 439/310 |
| 5,462,439 | A * | 10/1995 | Keith | 320/109 |
| 5,478,250 | A * | 12/1995 | Hoffman | 439/142 |
| 6,049,287 | A * | 4/2000 | Yulkowski | 340/693.12 |
| 6,113,342 | A * | 9/2000 | Smith et al. | 414/680 |
| 6,287,133 | B1 | 9/2001 | Yang | |
| 8,113,849 | B2 * | 2/2012 | Park, IV | 439/34 |
| 2009/0176391 | A1 * | 7/2009 | Brock et al. | 439/136 |
| 2010/0087096 | A1 | 4/2010 | Sloey et al. | |
| 2010/0159720 | A1 | 6/2010 | Wang et al. | |
| 2011/0306223 | A1 * | 12/2011 | Bauer | 439/136 |
| 2012/0082417 | A1 * | 4/2012 | Stanley et al. | 385/77 |

FOREIGN PATENT DOCUMENTS

| | | | |
|---|---|---|---|
| EP | 0481142 | A1 | 4/1992 |
| EP | 0852411 | A1 | 7/1998 |

* cited by examiner

*Primary Examiner* — James Harvey
(74) *Attorney, Agent, or Firm* — Kilpatrick Townsend & Stockton LLP

(57) ABSTRACT

A magnetically activated connector port cover or door that provides access through a connector port for a corresponding connector to mate with a receptacle connector behind the door, and closes the door when the connector is not presently proximate to or intending to mate with the receptacle connector. The connector port includes a magnetic element that works in tandem with an actuator to respond to the position of the corresponding connector and bias as well as move the door in an open or closed position accordingly.

23 Claims, 11 Drawing Sheets

MAGNETICALLY ACTIVATED CONNECTOR PORT COVER

BACKGROUND OF THE INVENTION

This invention relates generally to electronic media devices that include connectors and more particularly, port covers for connector ports on such electronic devices.

Electronic devices typically have one or more locations to provide access to external connectors, such as audio connectors, data connectors, power connectors and the like. These access points (sometimes referred to as "connector ports") also allow for dust and other debris to collect. Debris can disrupt the connection between electronic devices and external connectors.

Historically, some electronic devices included a connector port cover to prevent debris interference at the access location for external connectors. These covers sealed the connector port closed when not in use. Some connector port covers are cumbersome to operate between open and closed positions and may be easily breakable because space constraints led to less robust systems. In some instances, these factors have led to accidental or purposeful removal of the connector cover.

Some electronic devices have abandoned the inclusion of connector port covers for the aforementioned reasons. As a result, longer wiping distances may be implemented for electronic connectors to partly cope with the debris issues. However, this solution is not complete and requires a deeper connector. Consequently, connections can still be disrupted and scarce internal device space or other resources may be allocated to help remedy the debris issues. Hence, a need for connector port covers still exist, but the usefulness of future connector covers will depend on the extent to which the historical pitfalls can be overcome.

BRIEF SUMMARY OF THE INVENTION

In view of the shortcomings in currently available port covers as described above, the present invention provides a magnetically activated connector port cover to provide access for a corresponding connector to mate with a receptacle connector within an electronic media device and to seal the connector port cover closed when the connector is not presently proximate to or intending to mate with the electronic media.

In one embodiment, a connector port according to the present invention includes an opening having a door movable between a closed position where the opening is sealed and an open position for receiving a corresponding connector plug through the opening. An actuator is operatively coupled to bias the door in the closed position with a bias force. A magnetically responsive element that, when the corresponding connector plug is proximate to the opening in the connector port, is responsive to a magnetic field to provide a second force greater than the bias force that moves the door to the open position.

In another embodiment, a connector port according to the present invention includes an opening having a door movable between a closed position where the opening is sealed and an open position for receiving a corresponding connector plug through the opening. The connector port also includes an actuator for moving the door between its positions and a magnetically responsive element that biases the actuator when the corresponding connector plug is proximate to the opening in the connector port.

In yet another embodiment, a connector port according to the present invention includes an opening having a door movable between a closed position where the opening is sealed and an open position for receiving a corresponding connector plug through the opening. The connector port also includes a sensor that detects when the connector plug is proximate to the opening in the connector port and one or more electromagnets that bias the door in a sealed position and, in response to the sensor detecting that the connector plug is proximate to the opening, move the door to an open position allowing the connector plug to be inserted into the opening in the connector port.

To better understand the nature and advantages of the present invention, reference should be made to the following description and the accompanying figures. It is to be understood, however, that each of the figures is provided for the purpose of illustration only and is not intended as a definition of the limits of the scope of the present invention.

BRIEF DESCRIPTION OF THE DRAWINGS

The above and other advantages of the present invention will be apparent upon consideration of the following detailed description, taken in conjunction with the accompanying drawings, in which like reference characters refer to like parts throughout and in which.

DETAILED DESCRIPTION OF THE INVENTION

Embodiments of the present invention pertain to connector port assemblies that include a port cover (sometimes referred to herein as a "door") that automatically opens in response to the proximity of an external connector to the connector port.

The connector port cover may be suitable for a multiplicity of electronic devices including portable electronic media devices and others.

As used herein, an electronic media device includes any device with at least one electronic component that may be used to present human-perceivable media. Such devices may include, for example, portable music players (e.g., Apple's iPod devices), portable video players (e.g., portable DVD players), cellular telephones (e.g., Apple's iPhone devices), video cameras, digital still cameras, projection systems (e.g., holographic projection systems), gaming systems, PDAs, desktop computers, as well as tablet or other mobile computers (e.g., Apple's iPad devices). Some of these devices may be configured to provide audio, video or other sensory output.

Figure 1:
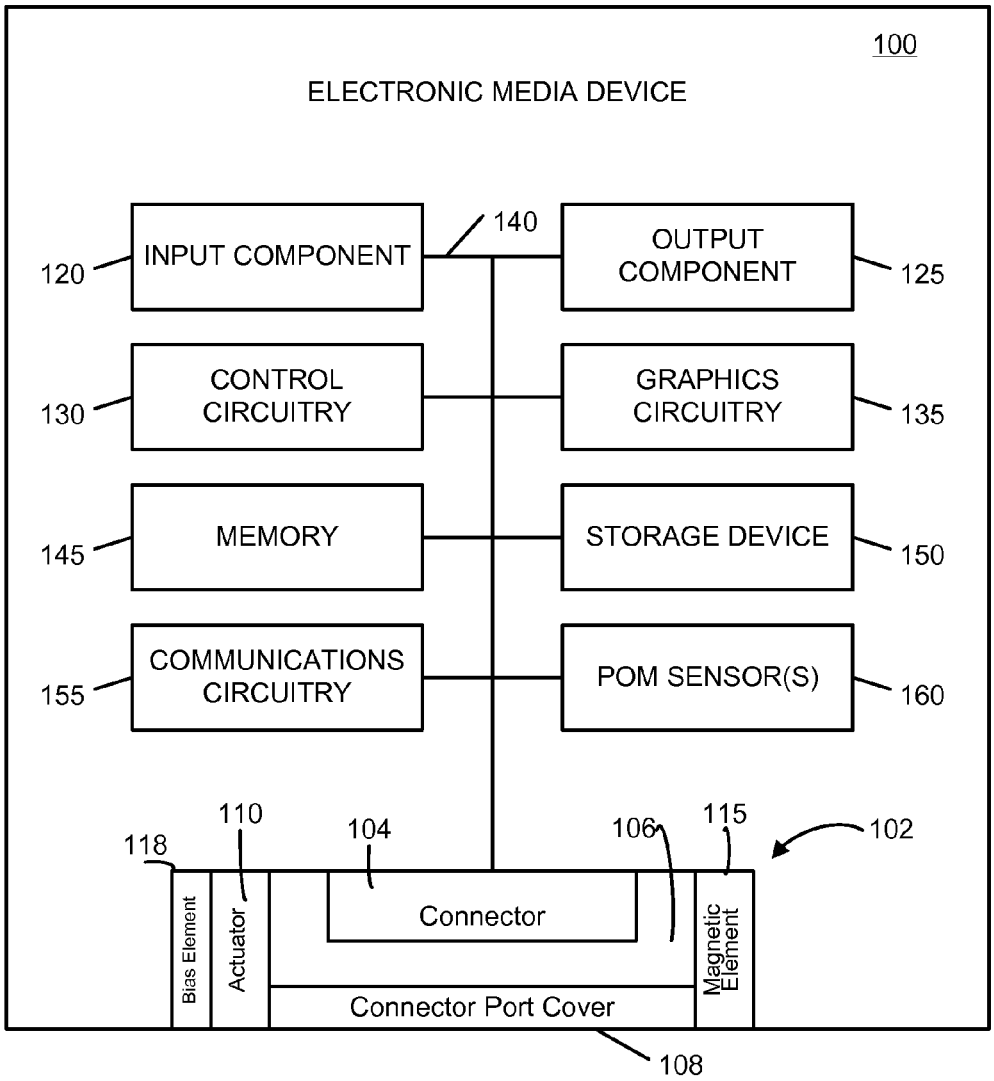
FIG. 1 is a simplified illustrative block diagram of an electronic media device in accordance with one embodiment of the invention.

FIG. 1 is a simplified illustrative block diagram representing an electronic media device 100 that includes a connector port assembly 102 according to one embodiment of the invention. Connector port assembly 102 includes a connector 104 positioned within a connector port 106, a port cover (door) 108 that covers an opening to the connector port, and an actuator 110 that opens and closes port cover 108. Connector port assembly 102 also includes a magnet 115 that is operatively coupled to the actuator and a bias element 118 that biases the port cover in a closed position to seal the connector port and prevent dirt, dust and other contaminants from collecting in the port.

Magnet 115 can be operatively coupled to open port cover 108 in response to a magnetic field. In one embodiment, a corresponding plug connector (not shown in FIG. 1) adapted to mate with connector 104 includes a magnet. When the plug connector is moved proximate to connector port 106, a magnetic field between the magnet in the plug connector and magnet 115 is created. In response to the magnetic field, magnet 115 provides a force on actuator 110 that is greater than the force applied by bias element 118 thus moving the door to the open position as described in detail below.

Electronic media device 100 may include, among other components, one or more user input components 120, one or more output components 125, control circuitry 130, graphics circuitry 135, a bus 140, a memory 145, a storage device 150, communications circuitry 155 and POM (position orientation or movement sensor) sensors 160. Control circuitry 130 may communicate with the other components of electronic media device 100 (e.g., via bus 140) to control the operation of electronic media device 100. In some embodiments, control circuitry 130 may execute instructions stored in a memory 145. Control circuitry 130 may also be operative to control the performance of electronic media device 100. Control circuitry 130 may include, for example, a processor, a microcontroller and a bus (e.g., for sending instructions to the other components of electronic media device 100). In some embodiments, control circuitry 130 may also drive the display and process inputs received from input component 120.

Memory 145 may include one or more different types of memory that may be used to perform device functions. For example, memory 145 may include cache, flash memory, ROM, RAM and hybrid types of memory. Memory 145 may also store firmware for the device and its applications (e.g., operating system, user interface functions and processor functions). Storage device 150 may include one or more suitable storage mediums or mechanisms, such as a magnetic hard drive, flash drive, tape drive, optical drive, permanent memory (such as ROM), semi-permanent memory (such as RAM) or cache. Storage device 150 may be used for storing media (e.g., audio and video files), text, pictures, graphics, advertising or any suitable user-specific or global information that may be used by electronic media device 100. Storage device 150 may also store programs or applications that may run on control circuitry 130, may maintain files formatted to be read and edited by one or more of the applications and may store any additional files that may aid the operation of one or more applications (e.g., files with metadata). It should be understood that any of the information stored on storage device 150 may instead be stored in memory 145.

Electronic media device 100 may also include input component 120 and output component 125 for providing a user with the ability to interact with electronic media device 100. For example, input component 120 and output component 125 may provide an interface for a user to interact with an application running on control circuitry 130. Input component 120 may take a variety of forms, such as a keyboard/keypad, trackpad, mouse, click wheel, button, stylus or touch screen. Input component 120 may also include one or more devices for user authentication (e.g., smart card reader, fingerprint reader or iris scanner) as well as an audio input device (e.g., a microphone) or a video input device (e.g., a camera or a web cam) for recording video or still frames. Output component 125 may include any suitable display, such as a liquid crystal display (LCD) or a touch screen display, a projection device, a speaker or any other suitable system for presenting information or media to a user. Output component 125 may be controlled by graphics circuitry 135. Graphics circuitry 135 may include a video card, such as a video card with 2D, 3D or vector graphics capabilities. In some embodiments, output component 125 may also include an audio component that is remotely coupled to electronic media device 100. For example, output component 125 may include a headset, headphones or ear buds that may be coupled to electronic media device 100 with a wire or wirelessly (e.g., Bluetooth headphones or a Bluetooth headset).

Electronic media device 100 may have one or more applications (e.g., software applications) stored on storage device 150 or in memory 145. Control circuitry 130 may be configured to execute instructions of the applications from memory 145. For example, control circuitry 130 may be configured to execute a media player application that causes full-motion video or audio to be presented or displayed on output component 125. Other applications resident on electronic media player 100 may include, for example, a telephony application, a GPS navigator application, a web browser application and a calendar or organizer application. Electronic media device 100 may also execute any suitable operating system, such as a Mac OS, Apple iOS, Linux or Windows and can include a set of applications stored on storage device 150 or memory 145 that is compatible with the particular operating system.

The applications available to a user of electronic media device 100 may vary widely. As one example, the applications may be grouped into application suites that provide similar or related functionalities. For example, the applications in one suite may include word processing and publishing applications (e.g., Keynote and Pages within the iWork suite) and another suite may include media editing tools (e.g., iWeb within the iLife suite). The applications within a given suite may have similar properties and other features that associate each application in a suite with the other applications in that suite. For example, the applications may feature a similar look and feel, may include a similar user interface, may include related features or functions and may allow a user to easily switch between the applications in the suite or include any suitable combination of the foregoing.

In some embodiments, electronic media device 100 may also include communications circuitry 155 to connect to one or more communications networks. Communications circuitry 155 may be any suitable communications circuitry operative to connect to a communications network and to transmit communications (e.g., voice or data) from electronic media device 100 to other devices within the communications network. Communications circuitry 155 may be operative to interface with the communications network using any suitable communications protocol such as, for example, Wi-Fi (e.g., a 802.11 protocol), Bluetooth, high frequency systems (e.g., 900 MHz, 2.4 GHz and 5.6 GHz communication systems), infrared, GSM, GSM plus EDGE, CDMA, quadband and other cellular protocols, VOIP or any other suitable protocol.

In some embodiments, communications circuitry 155 may be operative to create a communications network using any suitable communications protocol. Communications circuitry 155 may create a short-range communications network using a short-range communications protocol to connect to other devices. For example, communications circuitry 155 may be operative to create a local communications network using the Bluetooth protocol to couple with a Bluetooth headset (or any other Bluetooth device). Communications circuitry 155 may also include a wired or wireless network interface card (NIC) configured to connect to the Internet or any other public or private network. For example, electronic media device 100 may be configured to connect to the Internet via a wireless network, such as a packet radio network, an RF network, a cellular network or any other suitable type of network. Communication circuitry 145 may be used to initiate and conduct communications with other communications devices or media devices within a communications network.

Electronic media device 100 may also include any other component suitable for performing a communications operation. For example, electronic media device 100 may include a power supply, an antenna, ports or interfaces for coupling to a host device, a secondary input mechanism (e.g., an ON/OFF switch) or any other suitable component.

Electronic media device 100 may also include POM sensors 160. POM sensors 160 may be used to determine the approximate geographical or physical location of electronic media device 100. As described in more detail below, the location of electronic media device 100 may be derived from any suitable trilateration or triangulation technique, in which case POM sensors 160 may include an RF triangulation detector or sensor or any other location circuitry configured to determine the location of electronic media device 100.

POM sensors 160 may also include one or more sensors or circuitry for detecting the position orientation or movement of electronic media device 100. Such sensors and circuitry may include, for example, single-axis or multi-axis accelerometers, angular rate or inertial sensors (e.g., optical gyroscopes, vibrating gyroscopes, gas rate gyroscopes or ring gyroscopes), magnetometers (e.g., scalar or vector magnetometers), ambient light sensors, proximity sensors, motion sensor (e.g., a passive infrared (PIR) sensor, active ultrasonic sensor or active microwave sensor) and linear velocity sensors. For example, control circuitry 130 may be configured to read data from one or more of POM sensors 160 in order to determine the location orientation or velocity of electronic media device 100. One or more of POM sensors 160 may be positioned near output component 125 (e.g., above, below or on either side of the display screen of electronic media device 100).

Figure 2:
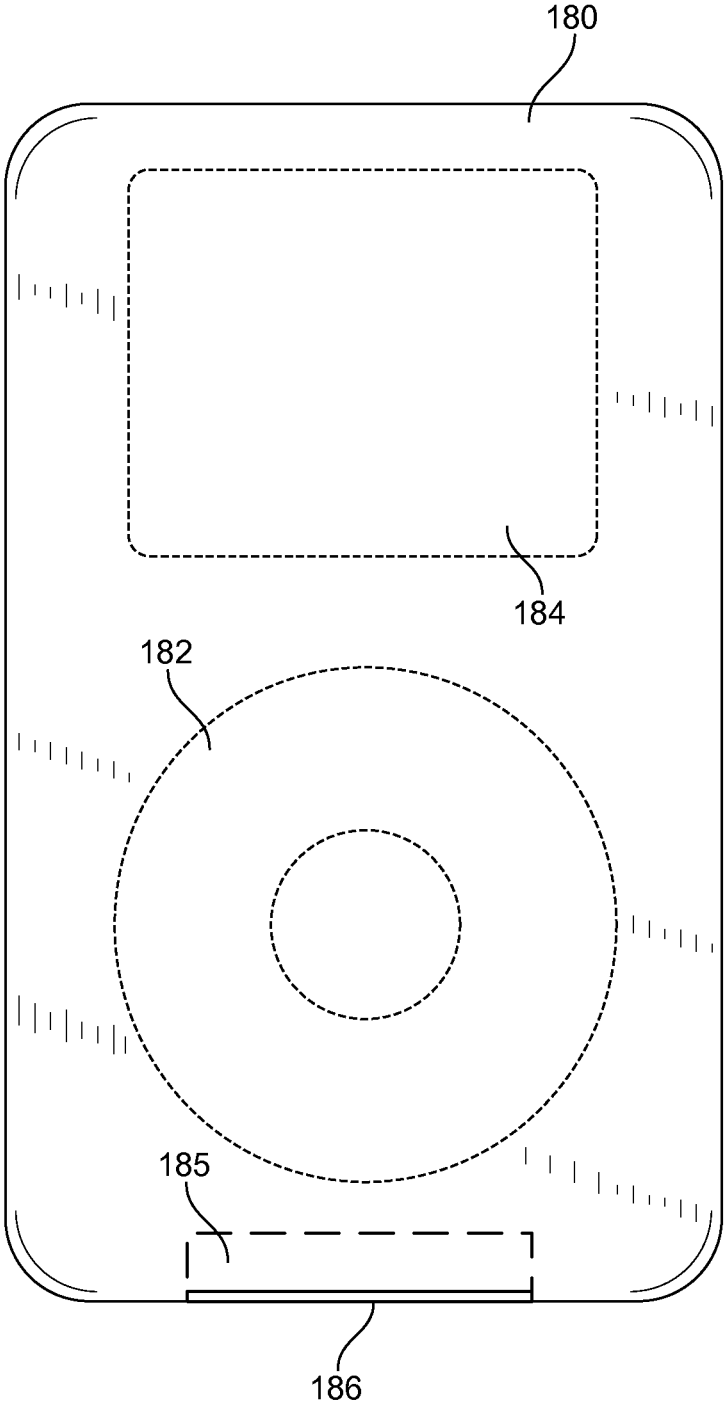
FIG. 2 depicts an illustrative rendering of one particular embodiment of an electronic media device suitable for use with embodiments of the present invention.

FIG. 2 depicts an illustrative rendering of one particular embodiment of an electronic media device 180. Device 180 includes a click wheel 182 as an input component and an LED display 184 as an output component. For simplicity, various internal components, such as the control circuitry, graphics circuitry, bus, memory, storage device and other components are not shown in FIG. 2.

Device 180 also includes a connector assembly 185, similar to assembly 102 discussed with respect to FIG. 1. Connector port assembly 185 includes a housing (not shown) that defines a connector port opening through which a corresponding plug connector can be inserted into a receptacle connector attached to the housing. A connector port cover 186 is positioned over the opening and is moveable between a closed position in which cover 186 seals the opening to prevent dirt and debris from collecting therein and an open position in which the corresponding plug connector (not shown) can be inserted. Connector port cover 186 can be opened in response to the presence of a magnetic field moved proximate to assembly 185 to enable a receptacle connector (not shown) within assembly 185 to be mated with a corresponding plug connector. Several exemplary implementations of connector port assemblies that can be used as assembly 102 and/or assembly 185 are discussed in detail below as representative embodiments of the present invention. A person of skill in the art will appreciate that connector port assembly 185 can be implemented in any of the embodiments described below as well as others that are evident to the skilled artisan based on the description herein.

Figure 3:
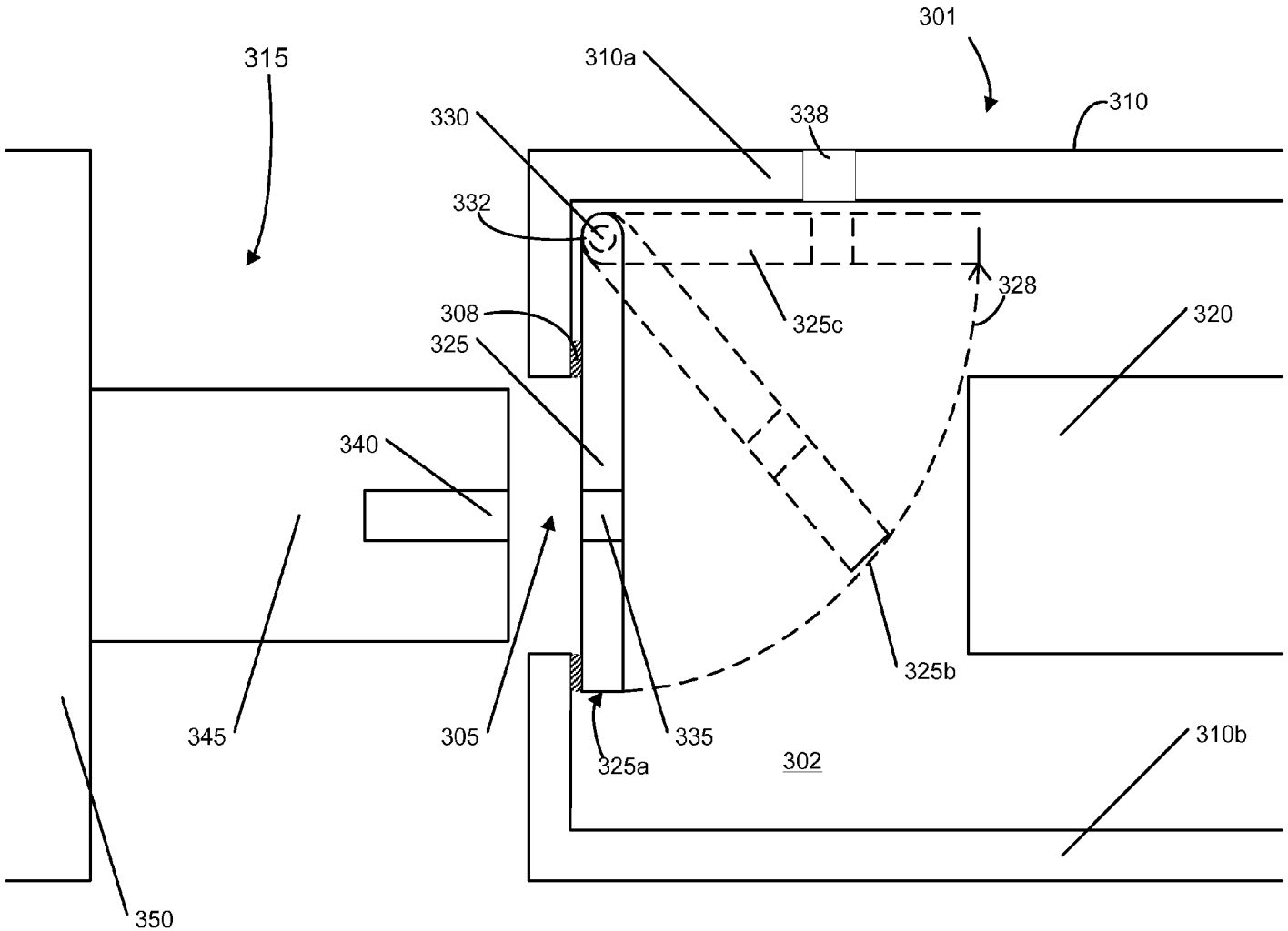
FIG. 3 shows a side or top/bottom view of an illustrative connector port cover in accordance with one embodiment of the invention.

FIG. 3 is a simplified cross-sectional side view of a connector port assembly 300 in accordance with one embodiment of the invention spaced apart from an external connector 315. Connector port assembly 300 may be housed within an electronic media device, such as media device 100 shown in FIG. 1. Typically, connector port assembly 300 is positioned on media device 100 such that opening 305 is located at an easily accessible exterior surface of the media device. As one example, opening 305 may be located on a bottom side surface of media device 100 so that the media device can sit upright in a docking station. In other embodiments, connector port assembly 300 can be positioned so that opening 305 is situated at any other suitable location on the media device.

Connector port assembly 300 includes a housing 310 that defines a cavity 302 in which a connector 320 is positioned. Housing 310 includes top and bottom walls **310*a* and 310*b*, respectively, which, along with left and right side walls (not shown), define cavity 302 as well as a central opening 305 through which a connector tip portion 345 of external connector 315 may be inserted to mate with connector 320. Housing 310 may be formed from any suitable type of material, which may include, for example, aluminosilicate glass, aluminum, stainless steel or polycarbonate plastic. Similarly, connectors 315 and 320 may be any suitable mating connectors. For example, in one embodiment, connector 315 may be a 30-pin plug connector while connector 320 is a 30-pin receptacle connector. Connector 315 may also be configured to mate with less than all of the pins associated with connector 320. For example, connector 315 may couple only to the pins for power, data or both power and data. For example, in some embodiments, an interface on electronic media device 100** includes four pins to communicate over a USB interface. One pin may be included for USB power (e.g., +5 VDC), one pin may be included for USB ground, one pin may be included for USB data (negative differential, for example, −3.3 VDC) and one pin may be included for USB data (positive differential, for example, +3.3 VDC). Any suitable number and types of pins carrying any suitable types of signals may be used in other embodiments.

Connector port assembly 300 may also include a connector port cover 325 proximate to opening 305. Connector port cover 325 may be moveable between a covering or closed position (325*a*) and an uncovered or open position (325*c*). In the closed position, port cover 325 covers opening 305 thereby preventing or limiting intrusion of solid particles such as dirt, crumbs, dust, lint and other substances which may otherwise enter into cavity 302 and be hard to clean or remove from the cavity. Over time, the accumulation of such particles may create potential for interference of or damage to the interface between connector 315 and connector 320.

In some embodiments, connector port assembly 300 includes a sealing member 308, such as an o-ring or a similarly suitable structure, positioned proximate to the outer edges of opening 305. In the closed position, port cover 325 contacts sealing member 308 to form an improved seal that may block fluid penetration into cavity 302. Potential for fluid penetration may originate from wet or moist conditions including snow, rain, fog, humidity or liquid contact resulting from spills, splashing, spraying or other wetting events. Fluid penetration can damage or adversely affect the components at the connection interface and other components within electronic media device 100 or connector 320.

Connector port cover 325 may be formed from any suitable type of material, which may include, for example, plastics or metals or blended materials. In some embodiments, connector port cover 325 may be doped with other materials, have embedded particles, have material inserts, be coated in another material or otherwise formed to include additional materials. The original or added materials of connector port cover 325 may include magnetic materials.

In the embodiment shown in FIG. 3, connector port cover 325 is moveable between an open and a closed position, pivoting at pivot point 330. In one embodiment, pivot point 330 is part of an actuator, e.g., a spring loaded hinge 332, that is biased to set port cover 325 in a closed, sealed position represented in FIG. 3 as position 325*a* and the solid outline of port cover 325. Port cover 325 may further include a magnet 335 while connector 315 may include a magnet 340. The poles of magnets 335 and 340 are aligned such that magnet 340 repels magnet 335 when connector 315 is moved proximate to opening 305. Magnets 335 and 340 are sufficiently strong that the magnetic force generated between the magnets overcomes the biasing force applied by spring-loaded hinge 332 to keep port cover 325 shut. The magnetic force thus opens port cover 325 from position 325*a* to 325*b* to 325*c* so that the end of the port cover opposite pivot point 330 moves along an arc (represented by dotted path 328). In this manner, port cover 325 can be opened without connector 315 ever coming in physical contact with port cover 325.

Magnets 335 and 340 can be made from any appropriate magnetic material, such as ferromagnetic or ferrous materials, diamagnetic, paramagnetic or other materials or any combination thereof. Magnets 335 and 340 may take the form of, for example, material inserts, dopant particles or doping agents or otherwise embedded particles at fixed locations along port cover 325 and connector 315. In some embodiments, magnets 335 and 340 are made of the same magnetic material while in other embodiments, magnets 335 and 340 may be made of different materials.

While the embodiment shown in FIG. 3 places magnets 335 and 340 at particular locations on port cover 325 and connector 315, respectively, magnets 335 and 340 may be located at any suitable location. For example, magnet 335 may be located closer to pivot point 330 on port cover 325 or closer to the distal end of port cover 325 and thus further from pivot point 330. Similarly, magnet 340 may be located at different locations along connector tip 345 and/or along the base 350 of connector 315 providing the magnets are positioned such that the magnetic field generated when they are proximate to each other is sufficient to overcome the bias force on port cover 325 and open the port cover.

In other embodiments, magnets are located in various locations throughout connector 315 and connector port assembly (including connector port cover 325). A multiplicity of configurations of magnet locations may operate in a multiplicity of different manners to provide an opening and closing functionality to connector port cover 325. Any suitable variation may be implemented, which may be based on different engineering, business and user interaction factors. In some embodiments, the entire connector port cover 325 or a shell of connector prong 345 made be made out of a magnetic material in which case magnets 335 and 340 may be the door or connector prong themselves.

Some embodiments of the invention include an additional magnet 338 attached to or positioned in housing 310. Magnet 338 can be located at a position proximate to magnet 335 when port cover 325 is in open position 325*c*. The magnetic field of magnet 338 is aligned to attract magnet 335 and help hold port cover 325 in the open position. Magnet 335 posses a magnetic field that, combined with the magnetic field extending from magnet 340, repulses magnet 335 away from magnet 340, and secures port cover 325 in open position 325*c* while connector 315 is mated with connector 320. The magnetic field of attraction between magnets 335 and 338, by itself, is insufficient to overcome the bias force applied by spring loaded hinge 332 and hold door 325 in open position 325*c*. In other words, the bias force applied by spring hinge 332 to close door 325 is greater than the magnetic force generated between magnets 335 and 338. Thus, when connector 315 is detached from connector 320 and removed from cavity 302, spring loaded hinge 332 forces door 325 away from magnet 338 into closed position 325*a*.

In other embodiments, connector port cover 325 may be magnetically attracted to connector 315. In this embodiment, the connector port cover 325 may initially be held in the closed position by some force that only is applied when connector port cover 325 is in the closed position 325*a* (e.g., a latch or another locking mechanism is holding it closed). An insertion force may be applied by connector 315 (e.g., a manual force supplied by a user) to connector port cover 325 and cause the connector port cover 325 to move from closed position 325*a* to open position 325*c*, allowing connector 315 to connect with connector 320. When connector 315 is later retracted from connector 320, the magnetic attractive forces between connector 315 and connector port cover 325 may cause connector port cover 325 to return to closed position 325*a* as it is magnetically guided to follow connector 315. The latch or other locking mechanism may be caused to be reengaged as connector 315 is retracted through opening 305 and connector port cover 325 is pulled against housing 310 by its magnetic attraction to connector 315.

In other embodiments, pivot point 330 may be a swivel, hinge, joint, pivot, flexible joint, elastic member or some other element about which connector port cover 325 may rotate. Pivot point 330 may be located at a variety of different locations within connector port assembly 300. For example, point 330 may be located nearest to housing 310*a* or nearest to housing 310*b*.

In some embodiments, pivot point 330 may be coupled with, for example, spring loaded hinge 332 as discussed above. Alternatively, other elements that provide a biasing force on connector port cover 325 may be implemented instead of spring loaded hinge 332, including other springs (e.g., torsion spring), biasing hinges (e.g., snap-hinge), biasing elastic members, or any other suitable mechanisms.

Figure 3A:
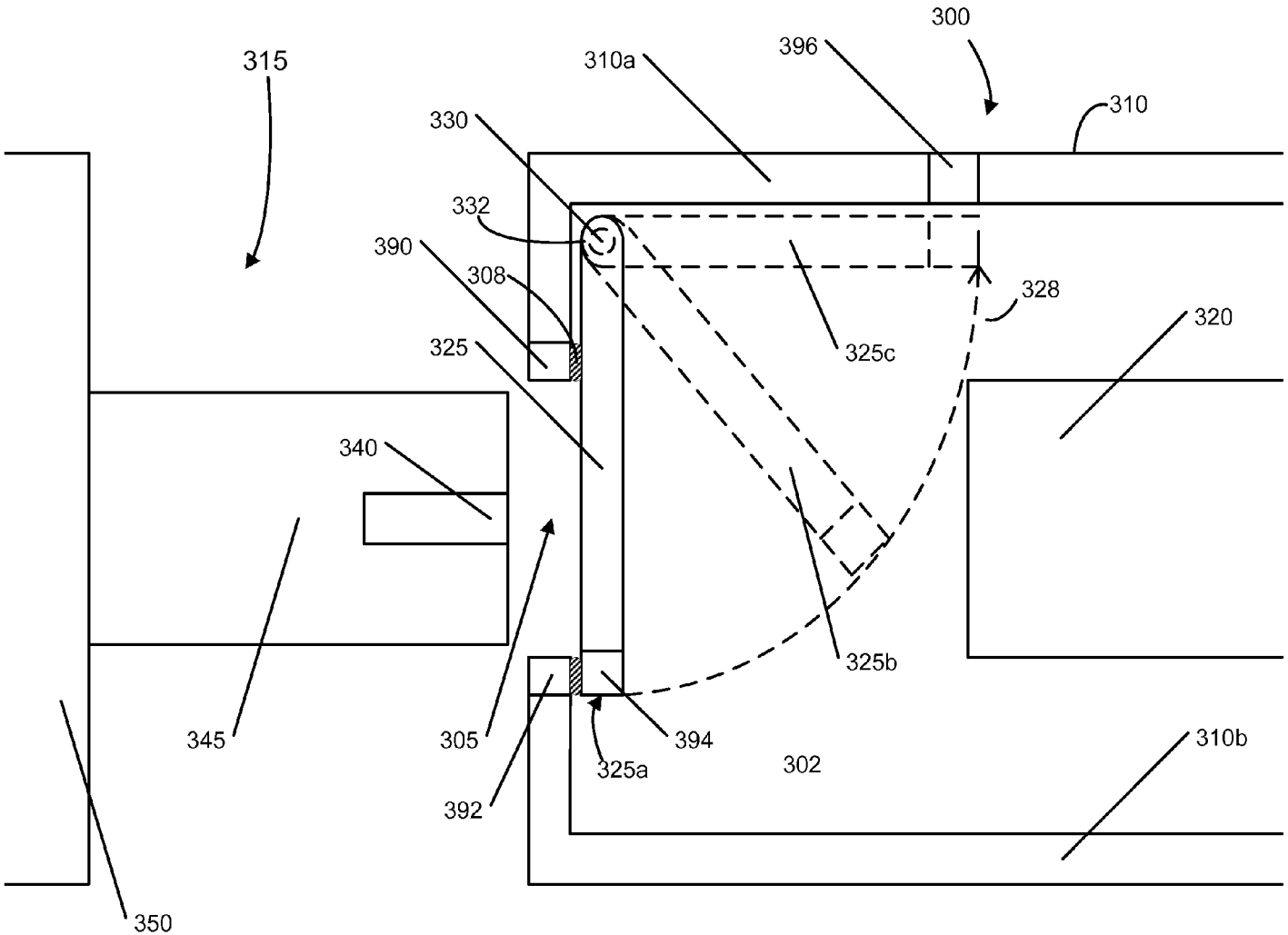
FIG. 3*a* shows a side or top/bottom view of an illustrative connector port cover in accordance with one embodiment of the invention.

FIG. 3*a* also shows a side or top view of an illustrative connector port cover in accordance with another embodiment of the invention. Connector port assembly 301 is similar to connector port assembly 300 in many regards, and for convenience like components are identified with the same reference numbers. Connector port assembly 301 may include sensor 390 that changes the polarity of electromagnets 392, 394, and 396 arranged within connector port assembly 300 to create a magnetic field that moves connector port cover 325 between open position 325*c* and closed position 325*a*, depending on the proximity of connector 315. For example, electromagnets 392 and 394 may initially be magnetically attracted to each other and electromagnets 394 and 396 may be magnetically repulsed by each other when connector 315 is not proximate to connector port assembly 300, causing connector port cover 325 to be held in closed position 325*a*. When connector 315 approaches connector port assembly 300, sensor 390 may alter the polarity of electromagnets 392, 394, and 396 such that electromagnets 392 and 394 become magnetically repulsed by each other and electromagnets 392 and 396 become magnetically attracted to each other. This change in polarity may create a magnetic field that causes connector port cover 325 to be magnetically repulsed when connector 315 is proximate, moving it from closed position 325*a* to open position 325*c* along arc 328. Thereafter, connector 315 may be connected to connector 320 through opening 305. When connector 315 is disconnected from connector 320 or no longer in proximity to connector port assembly 300, the polarity of the electromagnets may return to their initial scheme, causing connector port cover 325 to move from open position 325*c* to closed position 325*a*, along arc 328.

In other embodiments, the polarities, locations and number of electromagnets may be reconfigured to accomplish the same effect as described for the previous embodiment. Alternatively, electromagnets may be used in combination with other types of magnets to create the necessary magnetic field to move connector port cover 325 between positions.

In some embodiments, electromagnets 392, 394 and 396 may not only assist in moving connector port cover 325 into different positions, but may also assist in locking connector port cover 325 in certain positions, e.g., open position 325*c* or closed position 325*a*, by magnetically holding it in a position.

In some embodiments, sensor 390 may be an optical sensor. This optical sensor may be configured to detect the proximity of connector 315 to connector port assembly 300 and cause the polarity of electromagnets 392, 394 and 396 to change in order to accomplish a corresponding displacement of a connector port cover 325. In other embodiments, optical sensors may be configured to detect and grant access to specific connectors only. Thus, optical sensors may be used to prevent the improper opening or closing of opening 325 that may occur in some embodiments. For example, if an improper connector is introduced at connector port 305 the optical sensor would recognize this situation and it may not grant access to the improper connector.

Embodiments implementing optical sensors may also provide backwards compatibility between new connector port assembly 300 or new connectors 320 and previous generation connectors 315. The backwards compatibility could be achieved because materials 340 may no longer be necessary if an optical sensor is implemented. The embodiments including optical sensors may still implement magnets in other locations, but backwards compatibility may be achieved because materials 340, which may not be included in previous generations, would not be required to open or close connector port cover 325.

In some embodiments, sensor 390 may be a Radio-frequency identification (RFID) reader that is triggered by a RFID chip in connector 315. This would provide the advantage of allowing only a specific connector 315 to be able to gain access to connector 320; this may prevent the use of an incorrect connector 315 or exclude an unauthorized connector from gaining access to connector 320.

In other embodiments, sensor 390 may respond to a magnetic field. In these embodiments, connector 315 may include some magnetic materials. For example, magnetic material may be found within connector base 350, prongs 345 or material 340. Hence, when connector 315 is proximate to connector port assembly 300, whether because of the magnetic material in connector 315 or connector 315 otherwise affecting the magnetic field of connector port assembly 300, the magnetic field may change. This change in magnetic field may be detected by sensors, for example, a Hall Effect sensor. Hall Effect sensors are configured to detect magnetic fields, e.g., the magnetic filed created by a magnet in connector 315 (e.g., where material 340 is magnetic). In this manner, when connector 315 approaches connector port assembly 300, the Hall Effect sensor may detect its presence and trigger a response. For example, the Hall Effect sensor (or any of the previously discussed sensors) may be combined with circuitry to trigger a response based on the detection of a magnetic field (e.g., Hall Effect switch), such as changing the polarity of magnets, turning magnets on/off or enabling/disabling some other mechanism that supports the process of moving connector port cover 325.

Figure 3B:
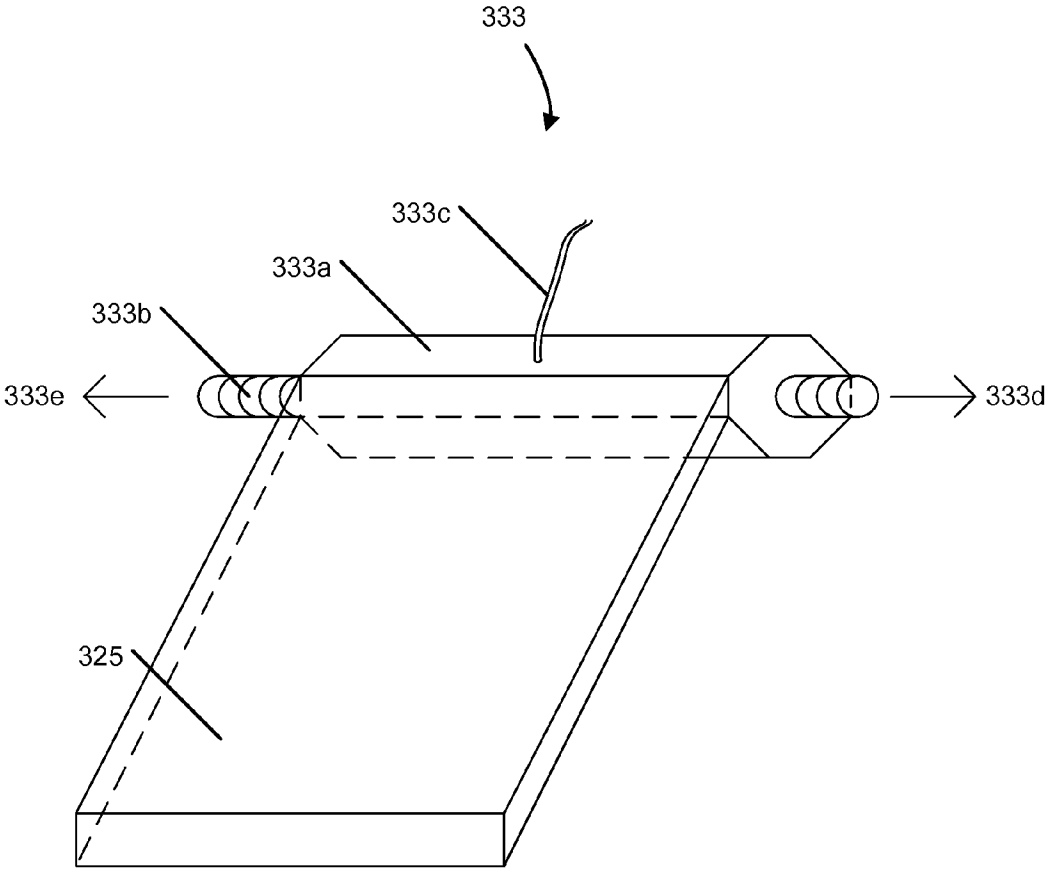
FIG. 3*b* shows an angled front view or three-dimensional view of an illustrative connector port cover and a specific motor element in accordance with one embodiment of the invention.

FIG. 3*b* is an angled front view or three-dimensional view of connector port cover 325 operatively coupled to a motor element 333 actuator instead of a spring loaded hinge according to a specific embodiment of the invention. Motor element 333 can be, for example, a SQUIGGLE® motor that is controlled or switch on/off by the sensor discussed previously. A SQUIGGLE® motor may include a bolt 333*a* and a threaded element 333*b*. The revolving action of the bolt 333*a* is created by applying power, e.g., via cord element 333*c*, to bolt 333*a* which includes piezoelectric elements. When the power is applied, ultrasonic vibrations cause bolt 333*b* to turn in a predetermined direction 333*d* or 333*e*, moving bolt 333*a* across the threads of threaded element 333*b*. This rotational motion of bolt 333*a* may be applied to connector port cover 325 to move connector port cover 325 between an open position (325*c* in FIG. 3) and a closed position (325*a* in FIG. 3) like a door on hinges (rotating about the axes of direction 333*e* and 333*d*). Alternatively, for example, instead of rotating connector port cover 325 between positions, connector port cover 325 may slide in direction 333*e* or 333*d* because the rotational motion of the bolt 333*a* may be translated into linear motion, moving the bolt 333*a* between the open and closed positions (325*a*, 325*b*).

In other embodiments, the motor element 333 may be substituted with any suitable motor mechanism suitable for assisting connector port cover 325 in moving between open and closed positions (325*a*, 325*b*).

Figure 4:
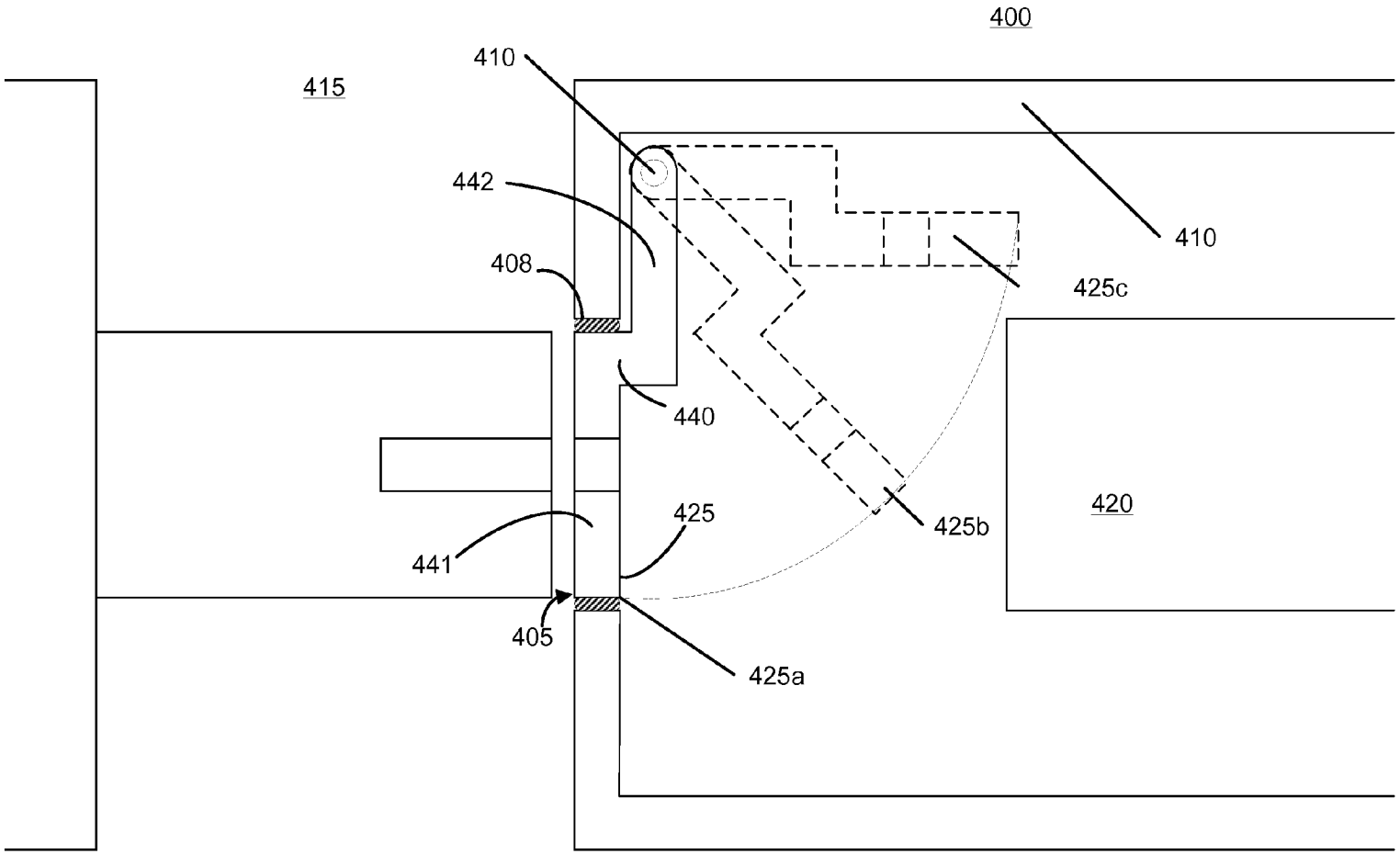
FIG. 4 shows a side or top/bottom view of an illustrative connector port cover in accordance with one embodiment of the invention.

FIG. 4 shows a simplified side cross-sectional view of a connector port cover in accordance with another embodiment of the invention. The embodiment shown in FIG. 4 is similar to that of FIG. 3 except that a different door configuration (connector port cover 425) is implemented. Connector port cover 425 hinges at pivot point 430 between open and closed positions (425*c*, 425*a*). Connector port cover 425 includes an L-shaped end section 441 that is shaped to fit within opening 405 and be flush with the outside of housing 410. As shown in FIG. 4, end section 441 is staggered from a base 442 of door 425 by an elbow 440. Seal 408 can be located along an inner edge of the portion of housing 310 that defines an opening 405 to cavity 302. Embodiments of FIG. 4 offer several advantages, including the advantages associated with connector port cover 425 being flush with the outside of housing 310 when in closed position 425*a*. This flush surface also eliminates additional gaps that may need to be sealed against debris and other particles. Furthermore, debris may not accumulate in these embodiments as it might in the embodiments of FIG. 3 wherein there is a depressed region on the exterior surface of connector port assembly 400 because the outside of connector port cover 325 is not flush with the outside of housing 310. This accumulation of debris may create a greater propensity for debris to eventually penetrate into cavity 302. Additionally, connector port cover 425 is structurally unified with housing 310 when flush, which may provide structural advantages to the system and decrease the propensity for connector port assembly 400 to get snagged on other objects.

In some embodiments, individual features and elements of FIG. 1-3 may be implemented in embodiments associated with FIG. 4, where suitable.

Figure 5:
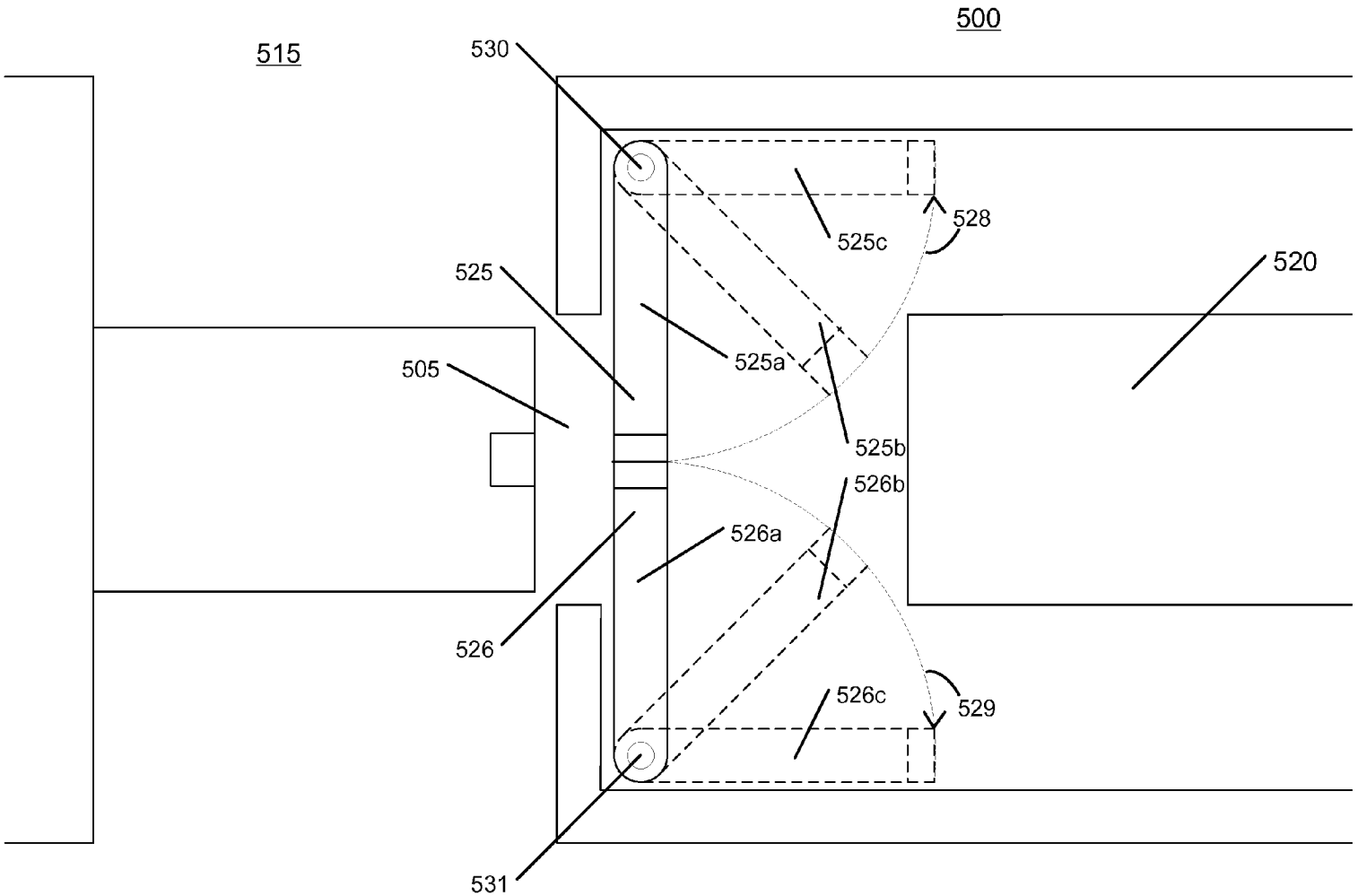
FIG. 5 shows a side or top/bottom view of an illustrative connector port cover in accordance with one embodiment of the invention.

FIG. 5 is a simplified side cross-sectional view of another embodiment of a connector port cover in an embodiment of the invention. The embodiment shown in FIG. 5 is similar to that shown in FIG. 3, except two connector port covers 525 and 526 work in tandem to cover a connector port opening 505 instead of just one. Specifically, connector port cover 525 may hinge on pivot point 530 and connector port cover 526 may hinge on pivot point 531 and move between open position (525*a*, 526*a*) and closed position (525*c*, 526*c*) along arc (528, 529).

In some embodiments, connector port covers 525 and 526 may be approximately half as long as connector port cover 325 of FIG. 3. In some embodiments, connector port cover 525 and 526 may not be of the same length but the sum of their lengths may equal or about equal to the length of connector port cover 325. As such, the combination of connector port cover 525 and 526 may require less clearance (i.e. depth within cavity 302) to open and close and connector 520 could accordingly be moved closer to opening 505. For example, the distance between connector 520 and opening 505 may be half of the distance between connector 320 and opening 305 (FIG. 3). This embodiment may be useful, depending on the internal configuration of connector port assembly 500, in saving space (within cavity 302) by necessitating less clearance.

In other embodiments, connector port covers 525 and 526 can be configured to open and close at rates faster than that of the embodiments of FIG. 3 because they may be smaller, i.e., arc 528 and 529 may have a shorter arc length than arc 328 (shown in FIG. 3). Additionally, the smaller sizes of connector port covers 525 and 526 may also require less force to move them to open position (525*c*, 526*c*), closed position (525*a*, 526*a*) and/or hold in a position between an open and a closed position (525*b*, 526*b*) because they may be smaller and weigh less. The weight decrease may also help to increase the opening and closing rates of connector port cover 525 and 526.

In some embodiments, individual features and elements of FIG. 1-4 may be implemented in embodiments associated with FIG. 5, where suitable.

Figure 6:
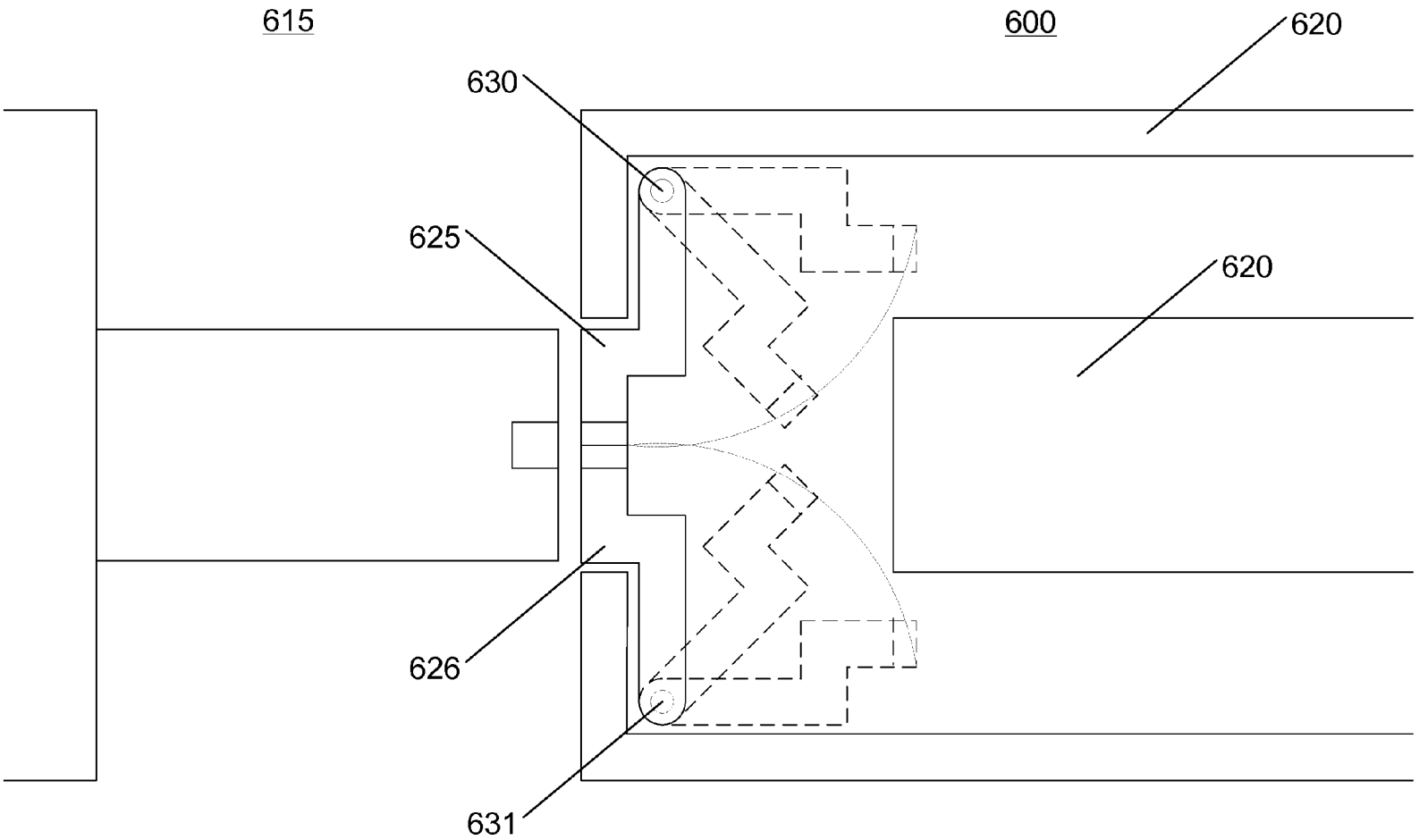
FIG. 6 shows a side or top/bottom view of an illustrative connector port cover in accordance with one embodiment of the invention.

FIG. 6 also shows a side or top view of an illustrative connector port cover in accordance with another embodiment of the invention. This embodiment is similar to those associated with FIG. 3, wherein a connector port cover hinges between an open and closed position. It is also similar to the embodiments associated with FIG. 4 in that the connector cover door is shaped such that it becomes flush with the outside of the device housing. Additionally, it is similar to the embodiments associated with FIG. 5 in that it includes two connector port covers that both hinges between open and closed positions and together open and close the opening through which the connectors are connected. Specifically, the connector port covers 625 and 626 of FIG. 6 may be caused to swing on pivot points 630 and 631 from a closed position to an open position by virtue of a magnetic field (created by magnets in connector 615 and connector port covers 625, 626) and that repulses them inward toward connector 620 when connector 615 is presented at the opening of connector port assembly 600 (similar to embodiments of FIG. 3). The advantage of the embodiments of FIG. 6 is that the benefits of each of the embodiments of FIGS. 3, 4 and 5 may be combined into a single embodiment, e.g., a flush surface between the outside of housing 610 and connector port cover 625 and 626, less clearance required for connector 620, and possibly faster and lighter connector port covers 625 and 626 by virtue of their shorter length.

In some embodiments, individual features and elements of FIG. 1-5 may be implemented in embodiments associated with FIG. 6, where suitable.

Figure 7:
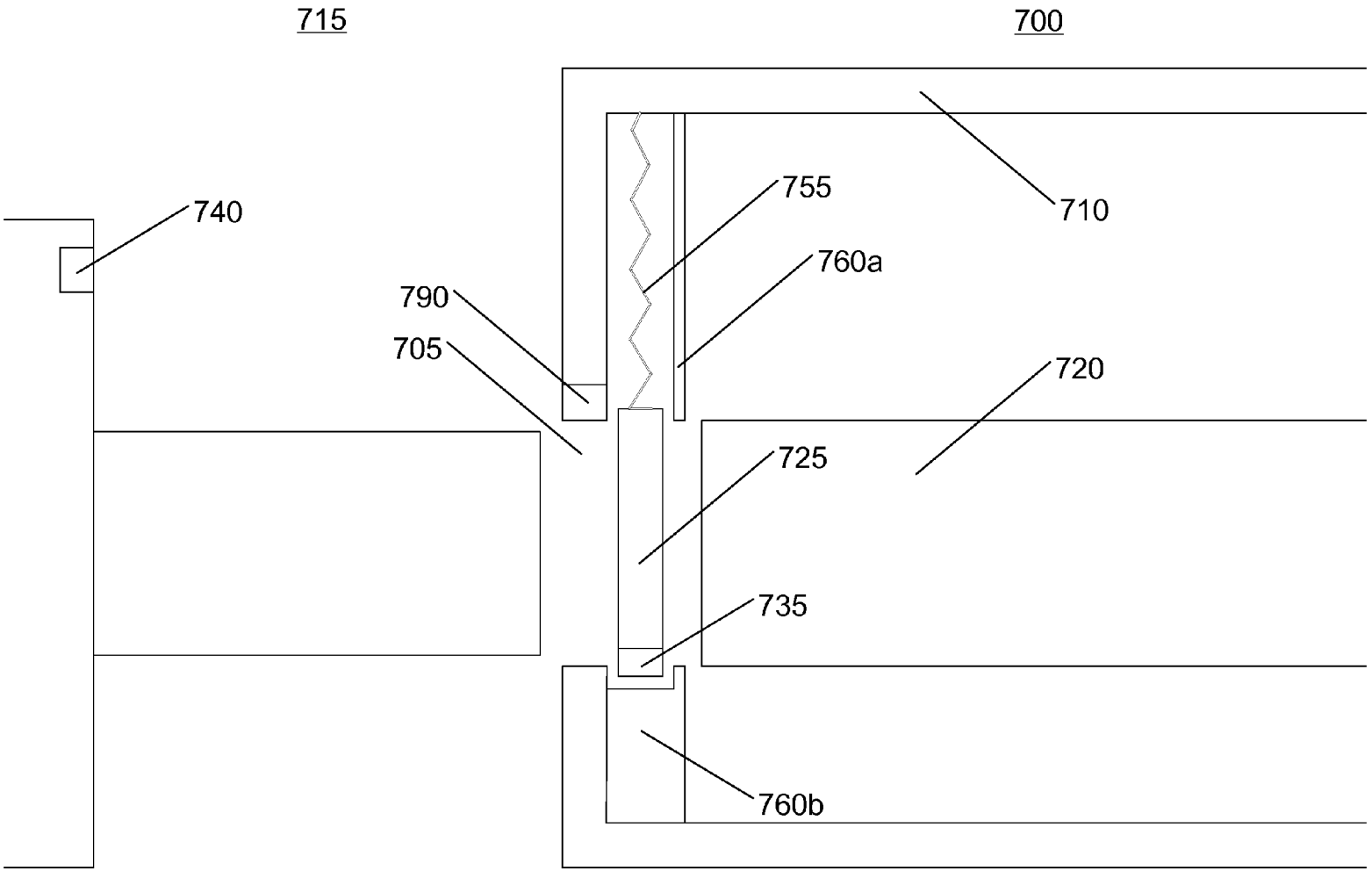
FIG. 7 shows a side or top/bottom view of an illustrative connector port cover in accordance with one embodiment of the invention.

FIG. 7 also shows a side or top view of an illustrative connector port cover in accordance with another embodiment of the invention. In embodiments of FIG. 7, the connector port cover 725 may be likened, for example, to a sliding door. Connector port cover 725 may be biased by spring 755 in the closed position. Guide elements 760*a* and 760*b* may ensure that connector port cover 725 moves along a particular path between open and closed positions. Materials 740, 735 may be magnetic materials. However, in some embodiments, connector 715 and connector port cover 725 may inherently contain magnetic materials. Materials 735 and 740 may be magnetically attracted to each other. When connector 715 approaches connector port assembly 700, the magnetic attraction between materials 740 and 735 may cause connector port cover 725 to move from the closed position, guided by guide elements 760*a* and 760*b*, towards a position that would allow connector 715 to be inserted into connector receptacle 720 through connector port 705—an open position.

In other embodiments, spring 755 may be replaced by other mechanisms that have a biasing effect on connector port cover 725. For example, any elastic material may be implemented between housing 710 and connector port cover 725 to bias connector port cover 725 in the closed position.

In other embodiments, connector port cover 725 may be biased by spring 755 or another biasing element in the open position, but held in the closed position by a magnet or a system of magnets. For example, guide element 760*b* and housing 710 may contain magnets, that cause connector port cover 725 to be biased in a closed position despite spring 755 or other biasing elements pulling connector port cover 725 towards an open position. The movement of connector port cover 725 may, at least in part, be attributable to magnetic interactions. For example, when connector 715 approaches connector port 705, the magnetic attraction between material 740 and 735 may overcome the force of spring 755 and magnets in 760*b* and housing 710, causing connector port cover 725 to retract to an open position and allow connector 715 to be inserted into connector 720.

In other embodiments, the magnetic interactions that cause connector port cover 725 to move between open and closed positions may utilize electromagnets and sensors. For example, electromagnets within connector port cover 725 and guide element 760*b* may hold connector port cover 725 in a closed position. As connector 715 moves towards connector port assembly 700, a sensor may cause the polarity of magnets within connector port cover 725 or material 735 to be changed, allowing spring 755 to retract connector port cover 725 into the open position. The same may be done with the polarity of magnets within housing 310; these changes in polarity or loss of magnetism may simply allow spring 755 to pull connector port cover 725 to the open position.

In some embodiments, the sensors described in the preceding paragraph may be optical sensors, Hall Effect sensors or other suitable sensors. Optical sensors may be used to detect the proximity of objects or connectors and trigger a response (e.g., changing the polarity of an electromagnet) within connector port assembly 700 to assist in moving connector port cover 725. Hall Effect sensors that are configured to respond to the magnetic properties of connector 715 as it approaches connector port assembly 700 may be implemented. The response triggered by the sensors in some embodiments, may include, for example, changing the polarity of magnets, turning magnets on or off or enabling and disabling some other mechanism that supports the process of moving connector port cover 725.

In other embodiments, a motor element may replace spring 755. The motor element may be triggered by some response to a change in magnetic fields (e.g., Hall Effect switch) or an optical reading (e.g., optical sensor and switch) or combined with a system of magnets and sensors to create the force necessary to move connector port cover 725. For example, the sliding door effect of the aforementioned embodiments of FIG. 7 may also be accomplished with a reeling and unreeling function, functionally similar to a roll up garage door, that causes connector port cover 325 to move between open and closed positions via a motor element. This may be done by reeling up a roll-up door element (connector port cover 725) or reeling up another element connected to the connector port cover 725 until the connector 720 is accessible to connector 715. The reeling may be accomplished with the aid of a SQUIGGLE® motor or another mechanism that produces a rotational force.

In some embodiments, guide elements 760*a* and 760*b* may not be necessary and magnets may be placed exclusively in housing 710 to cause connector port cover 725 to be held in the closed position.

In some embodiments, individual features and elements of FIG. 1-6 may be implemented in embodiments associated with FIG. 7, where suitable.

Figure 8:
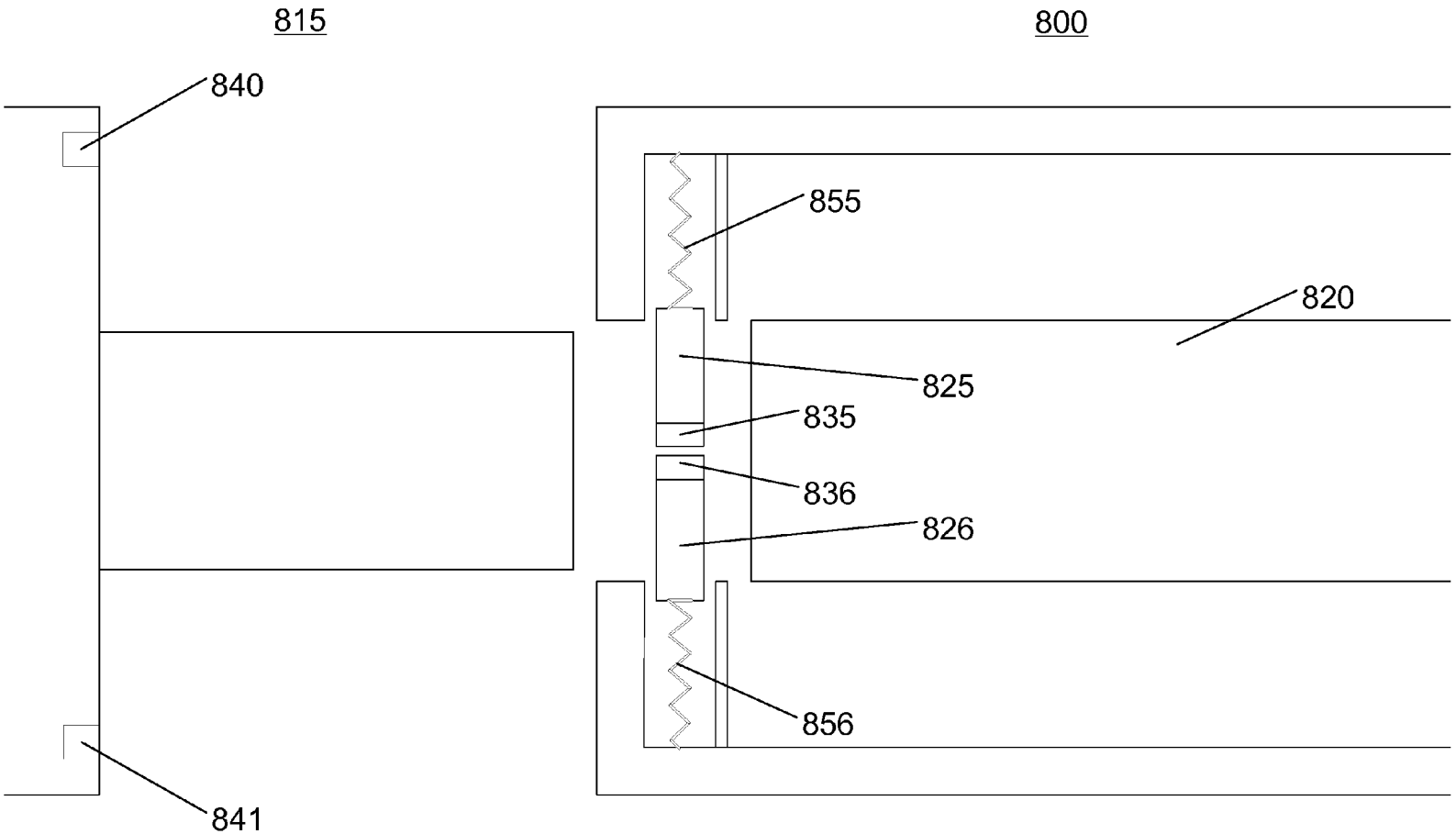
FIG. 8 shows a side or top/bottom view of an illustrative connector port cover in accordance with one embodiment of the invention.

FIG. 8 also shows a side or top view of an illustrative connector cover in accordance with another embodiment of the invention. This embodiment is similar to the embodiments associated with FIG. 7, but two connector port covers are implemented instead of one. These embodiments offer advantages over the embodiments of FIG. 7, similar to the advantages offered by FIG. 5 over FIG. 3, including, for example, faster movement of connector port covers, less force required to move and bias connector port covers. In these embodiments, magnetic elements 835 and 836 may be magnetically attracted to magnetic elements 840 and 841, respectively. Then, when connector 815 is brought within proximity to connector port assembly 800, the magnetic attraction between the magnetic elements may cause springs 855 and 856 to compress due to the magnetic force exerted by magnetic elements 835 and 836, causing them to move (pulling connector port covers 825 and 826 along with them) closer towards magnetic elements 840 and 841, respectively. After springs 855 and 856 have compressed, connector 815 may be inserted into connector 820. The aforementioned process may be reversed when connector 815 is retracted from connector 820.

In some embodiments, individual features and elements of FIG. 1-7 may be implemented in embodiments associated with FIG. 8, where suitable.

Figure 9:
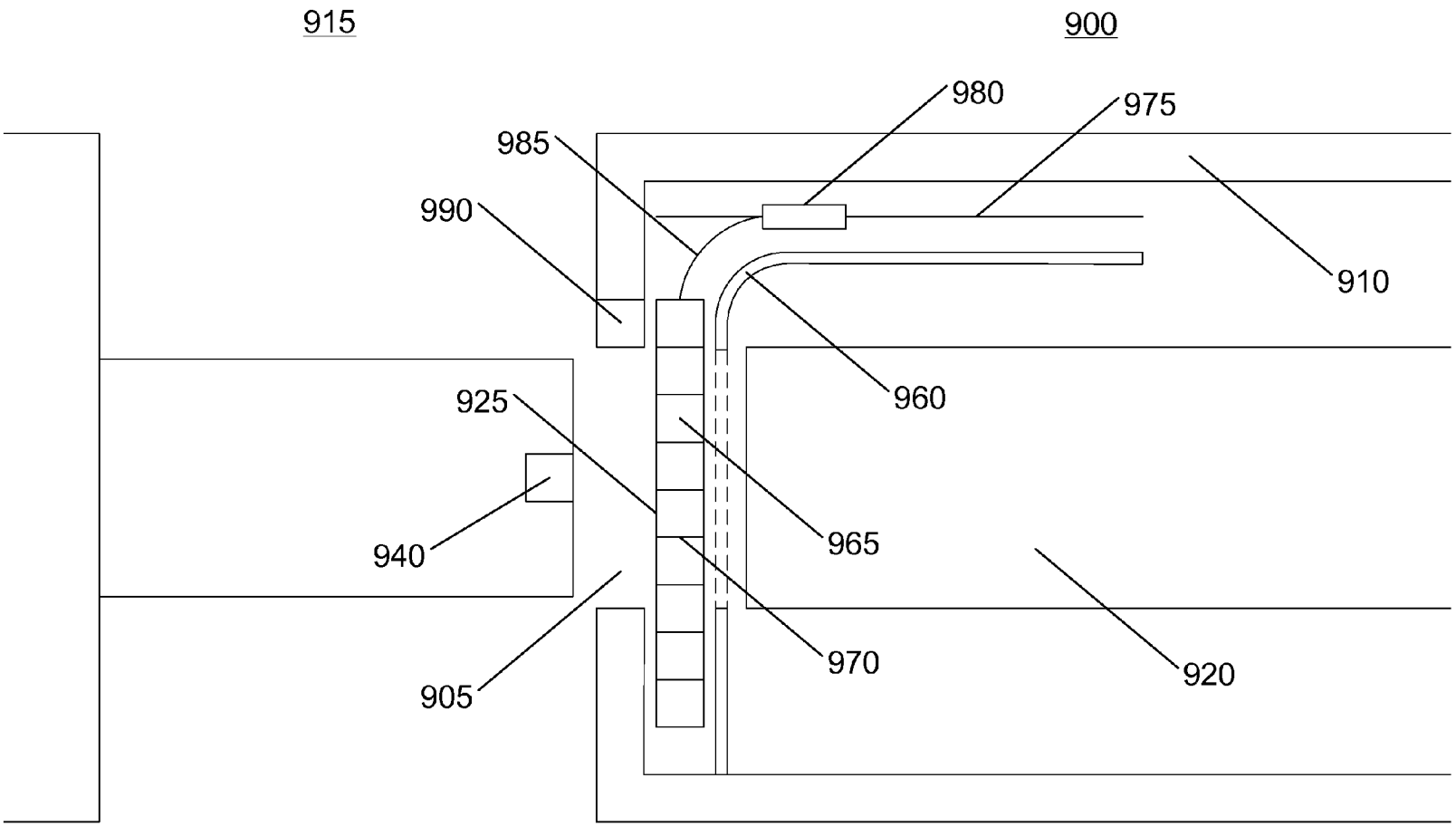
FIG. 9 shows a side or top/bottom view of an illustrative connector port cover in accordance with one embodiment of the invention.

FIG. 9 also shows a side or top view of an illustrative connector port cover in accordance with another embodiment of the invention. Connector port cover 925 may be described as functioning in a manner similar to a sectional garage door, wherein section elements 965, connected by hinge elements 970, fold as connector port cover 925 opens or closes. Guide element 960 and a track element 975 may be located along the range of motion of connector port cover 925 to help control the movement of connector port cover 925.

In some embodiments, guide element 960 may be similar to the guide of a garage door. Guide element 960 may be connected to connector port cover 925 with a roller-track interface or some other kind of dynamic connection. Guide element 960 may also not actually be connected to connector port cover 925, but rather run parallel to the full or partial range of motion of connector port cover 925. The adjacent position of guide element 960 to the range of motion of connector port cover 925 may serve to guide connector port cover 925 along a desired path. Track element 975 may work in tandem with motor element 980 to move connector port cover 925 between open and closed positions. Track element 975 may be connected to housing 910 or may be otherwise connected to connector port assembly 900. Track element 975 may be connected to connector port cover 925 by linking element 985. Motor element 980 may be any suitable mechanism for moving connector port cover 925 including, for example, a SQUIGGLE® motor. Sensor 990 may also be implemented to communicate with motor element 980. For example, a motor element 980 may receive commands from a sensor in the form of a Hall Effect sensor/switch which responds to the magnetic properties of connector 915 as its proximity to connector port 905 changes. Material 940 may also be implemented to provide a magnetic field for connector 915 to be sensed by the Hall Effect sensor/switch. These commands may result in motor element 980 causing connector port cover 925 to open and close in order to provide access to connector receptacle 920 or seal opening 905 closed.

Linking element 985 may be a cable, chain, rope or another suitable implementation for translating the force or movement of motor element 980 to connector port cover 925. It may be connected to track 975 or motor element 980.

Track element 960 may span the full or a partial range of motion of connector port cover 925. As discussed previously, track element 975 may be threaded. However, in other embodiments, track element 965 may be any suitable implementation for providing guidance or force to assist in the movement of connector port cover 925.

Section elements 965 of connector port cover 925 may be joined by hinges 970 to allow sections of connector port cover 925 to fold as necessary to retract connector port cover 925. Hinge 970 may be any suitable hinge, joint or another type of bearing that allows section elements 965 to rotate relative to each other. One or more implementations of hinge 970 may be used to provide the connection between section elements 965.

In some embodiments, wherein motor element 980 is a SQUIGGLE® motor, A SQUIGGLE® motor may take the form of a bolt that is threaded on track element 975. The revolving action of the SQUIGGLE® motor (in the form of a bolt and other components) is caused by applying power to piezoelectric elements on the bolt, creating ultrasonic vibrations that turn the bolt about the track element and move it in an opening or closing direction. Translating the rotational motion of the bolt to create the linear motion of the bolt may allow motor element 980 to open or close connector port cover 925 along track element 975. Motor element 980 may also be a series of motor elements placed in different locations to produce the force necessary to move connector port cover 925 between positions.

In other embodiments, Optical sensors may be also be implemented as previously described to send open and close commands to motor element 980. For example, the optical sensor may cause electromagnets implemented in various locations within housing 910 to turn on and off which may be sensed by a Hall Effect switch which may then send open and close commands to motor elements 980, causing connector port cover 925 to open or close.

In some other embodiments, connector port cover (e.g., 325 of FIG. 3) may be a bistable mechanism (e.g., a light switch or another compliant mechanism), wherein the mechanism's two "stable" positions are the open and the closed positions of a connector port cover. Thus, connector port cover may simultaneously have the capability to be biased in the open position or the closed position by virtue of the bistable mechanism's mechanical properties. Upon application of sufficient force, the mechanism may change from being biased in one position (e.g., closed or open) to being biased in the other position. The force necessary to move the bistable mechanism connector port cover between its stable positions may be created by a motor, a system of electromagnets and sensors or magnets, or another previously mentioned element capable of providing force.

In additional embodiments, a four bar mechanism; e.g., a four bar hinge, may alternatively serve as the pivot point for all previously mentioned embodiments.

In yet additional embodiments, implementing a locking mechanism, hinges or latches or other similar mechanisms may be used. For example, a latch mechanism may require a threshold force to place a connector port cover (e.g., 325 in FIG. 3) in a locked position and similarly to remove it from a locked position. Many of the previously discussed embodiments may be implemented in combination with locking mechanism implementations. Sensors, as previously discussed, may also provide input to locking mechanisms, unlocking or locking connector port cover in its position based on the proximity or position of an external connector (e.g., 315 in FIG. 3) in relation to an electronic media device.

In some embodiments, the internal connector (e.g., 320 in FIG. 3) may also move in relation to the opening and closing of the connector port door. For example, the internal connector (e.g., 320 in FIG. 3) may move away from connector port (e.g., 305 in FIG. 3) when the connector port cover moves from a closed position (e.g., 325*a* in FIG. 3) towards an open position (e.g., 325*c* in FIG. 3) and then back towards connector port (e.g., 305 in FIG. 3) once connector port cover has reached an open position (e.g., 325*c* in FIG. 3). This process may be repeated in reverse when the connector port cover moves back to a closed position. The purpose of this dynamic internal connector may be to allow full range of motion for the connector port cover to open and close where space constraints and the resulting position of the internal connector would otherwise prevent that full range of motion.

In some embodiments, alternative sealing implementations (e.g., sealing member 308, FIG. 3) may be used in combination with connector port cover (e.g., 325 in FIG. 3) to augment the seal on the connector port (e.g., 305 in FIG. 3). Sealing implementations may include, for example, dust seals, o-rings, gaskets, rubber seals, molded rubber parts, sponges, double-sided tapes, assembly tapes, adhesives, Velcro®, fabric over foam gaskets or other suitable sealing options. These implementations may serve to keep out small and large particles or work in combination with other locking mechanisms. These sealing implementations may be located on or around the electronic media device's housing (e.g., 310 in FIG. 3), connector port (e.g., 305 in FIG. 3) and connector port cover such that connector port cover (e.g., 325 in FIG. 3) is able to provide a better seal.

In some embodiments, the connector port cover (e.g., 325 in FIG. 3) is implemented on the exterior of a connector port assembly or in place of sections of housing (e.g., 310 in FIG. 3). A connector port cover (e.g., 325 in FIG. 3) may be implemented on the exterior of the housing of an electronic media device (e.g., 310 in FIG. 3) as a door that functions in a manner similar to those already discussed. However, instead of pivoting away from the connector (e.g., 315 in FIG. 3), it may pivot towards the connector (e.g., 315 in FIG. 3) to provide access to a connector receptacle (e.g., 320 in FIG. 3) through connector port (e.g., 305 in FIG. 3). There may be challenges in implementing this embodiment as the opening of connector port cover in this implementation may run into the external connector as it is inserted. The functionality of several previously discussed embodiments may be implemented herein to overcome these challenges. For example, a sensor may be used to detect the proximity of an external connector, and cause the connector port cover to open before the external connector is so close that there is not sufficient clearance for connector port cover to open.

As will be understood by those skilled in the art, the present invention may be embodied in other specific forms without departing from the essential characteristics thereof. Various configurations described herein may be combined without departing from the present invention. The above described embodiments of the present invention are presented for purposes of illustration and not of limitation. The present invention also can take many forms other than those explicitly described herein. Those skilled in the art will recognize, or be able to ascertain, using no more than routine experimentation, many equivalents to the specific embodiments of the invention described herein. Accordingly, it is emphasized that the invention is not limited to the explicitly disclosed methods, systems and apparatuses, but is intended to include variations to and modifications thereof which are intended to be encompassed by the following claims.

What is claimed is:

1. A connector port having an opening, the connector port comprising:

a door movable between a closed position where the opening is sealed and an open position for receiving a corresponding connector plug through the opening;

an actuator operatively coupled to the door to bias the door in the closed position with a bias force; and a magnetically responsive element that, when the corresponding connector plug is proximate the opening in the connector port, is responsive to a magnetic field to provide a second force greater than the bias force that moves the door to the open position.

2. The connector port set forth in claim 1 wherein the door pivots around a pivot point to move between the open and closed positions.

3. The connector port set forth in claim 2 wherein the actuator comprises a spring-loaded hinge.

4. The connector port set forth in claim 2 wherein the actuator comprises a motor.

5. The connector port set forth in claim 1 wherein the door includes first and second door sections that are separately moveable between the closed and open positions.

6. The connector port set forth in claim 5 wherein the first door section pivots around a first pivot point and the second door section pivots around a second pivot point located on an opposite side of the opening as the first pivot point.

7. The connector port set forth in claim 1 wherein the door slides across the opening when moving between a closed to open position.

8. The connector port set forth in claim 7 wherein the door is biased in the closed position by a spring.

9. The connector port set forth in claim 1 wherein the door comprises a plurality of sections, with each section being joined to an adjacent section by a hinge and wherein, when moving from a closed to open position, the door slides across the opening into a location aligned with the depth of the opening.

10. A connector port having an opening, comprising:

a door movable between a closed position where the opening is sealed and an open position for receiving a corresponding connector plug through the opening;

an actuator for moving the door between its positions; and a magnetically responsive element that biases the actuator when the corresponding connector plug is proximate the opening in the connector port.

11. The connector port set forth in claim 10 wherein the actuator is a motor.

12. The connector port set forth in claim 10 wherein the door slides across the opening when moving between the closed and the open position.

13. The connector port set forth in claim 10 wherein the door includes first and second door sections that are separately moveable between the closed and open positions.

14. The connector port set forth in claim 10 wherein the door comprises a plurality of sections, with each section being joined to an adjacent section by a hinge and wherein, when moving from a closed to open position, the door slides across the opening into a location aligned with the depth of the opening.

15. The connector port set forth in claim 10 wherein magnetically responsive elements in the door and the connector port are responsive to a magnetic field to a provide bias force that holds the door in the closed position.

16. A connector port having an opening, comprising:

a door movable between a closed position where the opening is sealed and an open position for receiving a corresponding connector plug through the opening;

a sensor that detects when the connector plug is proximate the opening in the connector port; and one or more electromagnets that bias the door in a sealed position and, in response to the sensor detecting that the connector plug is proximate the opening, move the door to an open position allowing the connector plug to be inserted into the opening in the connector port.

17. The connector port set forth in claim 16 wherein the sensor is an optical sensor.

18. The connector port set forth in claim 16 wherein the sensor is a Hall effect switch.

19. The connector port set forth in claim 16 wherein the sensor is an RFID sensor.

20. The connector port set forth in claim 16 wherein the door includes first and second door sections that are separately moveable between the closed and open positions.

21. The connector port set forth in claim 16 wherein the door slides across the opening when moving between a closed to open position.

22. The connector port set forth in claim 16 wherein the door comprises a plurality of sections, with each section being joined to an adjacent section by a hinge and wherein, when moving from a closed to open position, the door slides across the opening into a location aligned with the depth of the opening.

23. The connector port set forth in claim 18 wherein the electromagnets cause the door to move between its positions by creating magnetic fields, in response to the proximity of the corresponding connector plug, detectable by the Hall effect switch and wherein the Hall effect switch communicates with an actuator operatively coupled to the door that moves the door between its positions based on the detected magnetic fields.

* * * * *